United States Patent [19]

Goloff et al.

[11] 4,343,355

[45] Aug. 10, 1982

[54] LOW STRESS HEAT EXCHANGER AND METHOD OF MAKING THE SAME

[75] Inventors: Alexander Goloff, East Peoria; George B. Grim, Washington, both of Ill.

[73] Assignee: Caterpillar Tractor Co., Peoria, Ill.

[21] Appl. No.: 130,489

[22] PCT Filed: Jan. 14, 1980

[86] PCT No.: PCT/US80/00027

§ 371 Date: Jan. 14, 1980

§ 102(e) Date: Jan. 14, 1980

[87] PCT Pub. No.: WO81/02060

PCT Pub. Date: Jul. 23, 1981

[51] Int. Cl.[3] ..... F28F 3/00

[52] U.S. Cl. ..... 165/166

[58] Field of Search ..... 165/157, 166, 167

[56] References Cited

U.S. PATENT DOCUMENTS

| | | | |
|---|---|---|---|
| 2,143,269 | 1/1939 | Hubbard | 165/166 |
| 2,400,617 | 5/1946 | Wheller | 165/166 X |
| 2,953,110 | 9/1960 | Etheridge | 165/165 X |
| 3,552,488 | 1/1971 | Grill | 165/166 |
| 3,759,323 | 9/1973 | Dawson et al. | 165/166 |

FOREIGN PATENT DOCUMENTS

| | | | |
|---|---|---|---|
| 580039 | 8/1924 | France | 165/166 |

*Primary Examiner*—Samuel Scott
*Assistant Examiner*—Theophil W. Streule, Jr.
*Attorney, Agent, or Firm*—Sixbey, Friedman & Leedom

[57] ABSTRACT

A low stress heat exchanger (50) and method for making the same is provided wherein thin heat exchange members (18, 20, 64, 66) are joined to thicker support members (44, 84) by causing the thin members (18, 20, 64, 66) to extend tangentially from a radiused surface (84) of the support member (44, 84). The thin members (18, 20, 64, 66) are then secured to the support member (44, 84) in an area (42, 88) remote from the area (46, 48) where the thin members (18, 20, 64, 66) extend tangentially from the support member (44, 84).

The heat exchanger (50) includes closure tabs (14, 16) for bridging a space at the ends of fluid passages (36) defined by spaced wall members (18, 20).

9 Claims, 10 Drawing Figures

LOW STRESS HEAT EXCHANGER AND METHOD OF MAKING THE SAME

DESCRIPTION

1. Technical Field

This invention relates generally to a low stress heat exchanger module for use in devices such as gas turbines which use recuperators and a method for forming the same, and more particularly to a module formed from one or more single sheet, primary surface heat exchanger core units .

2. Background Art

U.S. Pat. No. 3,759,323 issued to Harry J. Dawson et al describes an important prior art primary surface heat exchanger for use as a recuperator core of a gas turbine. Dawson et al discloses a heat exchanger core made from a multiplicity of thin metal sheets which have been corrugated or folded in a wavy pattern to provide fluid passages on opposite sides of the sheet. A large number of these metal sheets are stacked on top of each other, and the edges of the sheets are crushed to form the flat sections necessary to encase the assembly and to allow the attachment of suitable manifolding for conveying hot and cold fluid to the passages.

In the Dawson et al structure, it is necessary to weld the crushed ends of the thin metal sheets to thicker metal members such as spacer bars, header plates, etc. Other known heat exchanger structures have used welding to selectively close the ends of fluid passages formed in thin metal heat exchange sheets. In all of these prior known heat exchange structures, the welds have often occured at the end of what, in effect, constitutes a prebuilt crack.

It is well established that welds must not be located in regions of high stress, and this automatically means that welds must not be placed so that they constitute the end of a prebuilt crack where the stress concentration is upredictably high. However, in prior heat exchange structures, it has not been possible to effectively place the welds in low stress areas, so that core failures, which would not otherwise have occurred, were often initiated at a weld.

Preformed cracks and other high stress areas arise when a thin metal or ceramic material is welded or bonded to a thicker support member. Also the failure of a weld to penetrate at certain junctions within the heat exchange core results in a preformed crack. The effect of crushing the corrugated edges of the Dawson et al heat exchange plate has been that of producing a multiplicity of cracks.

While the stress concentration factors present at the welds in prior heat exchange structures may not be significant when the assembly is preloaded in compression, as intended, and when the transients are not steep, high stresses which lead to premature failures may appear under severe operating conditions and after prolonged periods of operation during which the preload is likely to be relaxed.

The present invention is directed to overcoming one or more of the problems as set forth above.

DISCLOSURE OF THE INVENTION

In one aspect of the present invention, a novel method is provided for making a junction within a heat exchanger by wrapping a thin metallic member around a thicker metallic member so that the thin member extends off tangentially from the thick member. A weld is then placed away from the point where the thin member tangentially leaves the thick member.

In another aspect of the present invention, a low stress single sheet primary surface heat exchanger core unit is provided which is formed from a single sheet of thin material pleated to any depth desired. Before pleating, the longitudinal edges of the thin sheet are provided with tabs which selectively close end sections of the completed core. These tabs are curled so that when the pleated sheet is compressed to form a pleated assembly, adjacent tabs overlap and may be welded together in a region of relatively low stress.

These and other objects of the present invention will be more readily apparent from a consideration of the following description taken together with the accompanying drawings.

BEST MODE FOR CARRYING OUT THE INVENTION

Figure 1:
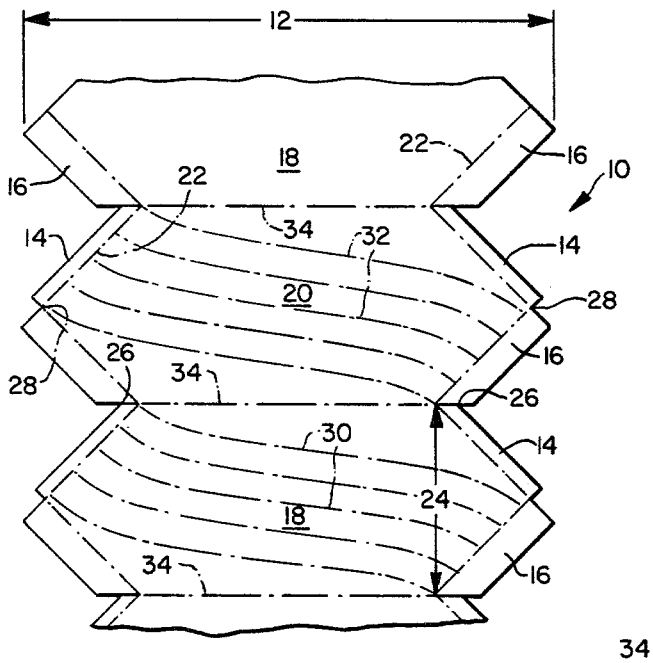
FIG. 1 is a plan view of a section of single sheet of heat exchange material employed to form a heat exchange core for the heat exchanger of the present invention.

FIG. 1 illustrates a section of a single sheet 10 used to form a pleated core section for one embodiment of the heat exchanger module of the present invention. The single sheet is a long rectangular strip of heat exchange material, for example a suitable thin metal, such as heat resistant steel, and the width of the sheet indicated at 12, may be varied by the designer to fit the desired heat exchanger application. The longitudinal edges of the sheet are cut to form a narrow tab 14 and a wider tab 16 which define the outer edges of alternating sections 18 and 20. When the tabs 14 and 16 are folded along the broken lines 22, a sawtooth pattern is formed along the edges of the sheet 10 with the distance 24 between notches 26 approximately equal to the desired height of the pleated core. The distance between the apexes 28 of the sawtooth edges and the notches 26 should be substantially equal to the height of the pleated core as indicated at 24 to eliminate fluid flow blockage in the completed core.

The narrow tabs 14 extend from the apex 28 on each side of a section 18 or 20 to the notch 26 on one end of the section, and the wide tabs 16 extend from the apex on each side of a section to the notch at the remaining end thereof. Thus the edges of each section are bounded by two opposed narrow tabs and two opposed wide tabs, and the narrow and wide tabs alternate along the edges of the sheet 10.

Figure 2:
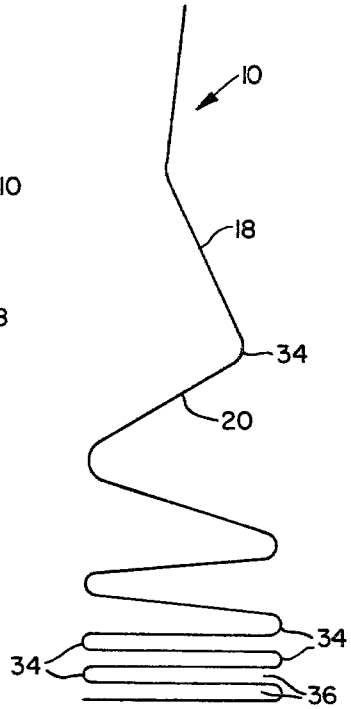
FIG. 2 is a view in side elevation of the sheet of FIG. 1 during the pleating thereof.

The pleated core section is formed in a manner depicted in FIG. 2. The sections 18 and 20 of the sheet of heat exchange material 10 are first embossed by means of conventional dies, shaped rollers or any other suitable embossing method. The embossing serves to separate the subsequently formed pleats of the heat exchanger core section accurately and to provide channels which guide the fluid flow through the completed core.

Since the sheet 10 will be pleated into a pleated section which forms part of the core of a heat exchanger module, it is necessary to emboss the sheet so that the pleats are spaced far enough apart to allow fluid flow between them. This is accomplished by embossing sections 18 and 20 in opposite directions. For example, in FIG. 1, the bosses 30 forming channels on section 18 may project upwardly, while the bosses 32 on section 20 project downwardly. This alternate arrangement is maintained throughout the length of the sheet 10.

Figure 3:
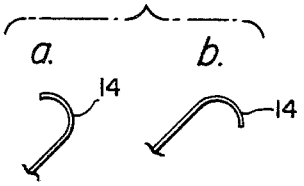
FIGS. 3*a* and 3*b* are diagrammatic illustrations of a side view of the narrow tabs of FIG. 1.
Figure 4:
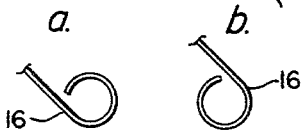
FIGS. 4*a* and 4*b* are diagrammatic illustrations of a side view of the wide tabs of FIG. 1.

After the sheet 10 is embossed, the tabs 14 and 16 are bent in the manner illustrated in FIGS. 3 and 4, before the sheet is pleated. The narrow tabs 14 are curled either up (FIG. *3a*) or down (FIG. *3b*) from the lines 22 to form an elongated arcuate segment extending along one half of either end of each section 18 and 20. The arcuate segment formed by each tab 14 extends along about 90 degrees of arc.

Similarly, the wide tabs 16 are curled either up (FIG. *4a*) or down (FIG. *4b*) from the lines 22 to form elongated circular segments extending along the remaining half of either side of each section 18 and 20. These wider tabs are curled to complete or nearly complete a full circle.

Once the sheet 10 is embossed and the tabs 14 and 16 are curled, the sheet is pleated by folding it along lines 34 between sections 18 and 20. Pleating may be accomplished mechanically in a conventional manner, such as on machines utilizing dull-edged knife blades like those used for pleating filter paper in the manufacture of air cleaners and oil filters, but which have been modified to pleat thin metal or heat exchange material rather than paper. FIG. 2 shows the sheet 10 pleated and compressed at the lower end to form a pleated core. The sections 18 and 20 of the sheet are compressed together until the raised bosses which form the fluid guide channels contact the next adjacent section of the sheet. Thus the height of such bosses accurately controls the spacing between adjacent sections when the sheet 10 is pleated and compressed. To enable the bosses to perform this spacing function, it is imperative that the bosses on adjacent sections 18 and 20 be precluded from nesting when the sections are compressed together. This may be accomplished by offsetting the bosses on section 18 so that they fall in the spaces between the bosses on section 20 when the two sections are pleated. In addition, the bosses may be of different depths, and it is possible to have both deep and shallow bosses on the same sheet.

Figure 5:
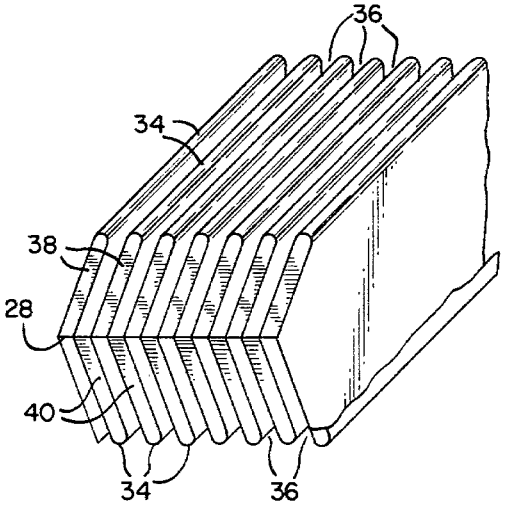
FIG. 5 is a perspective view of a heat exchanger core formed from the sheet of FIG. 1.
Figure 6:
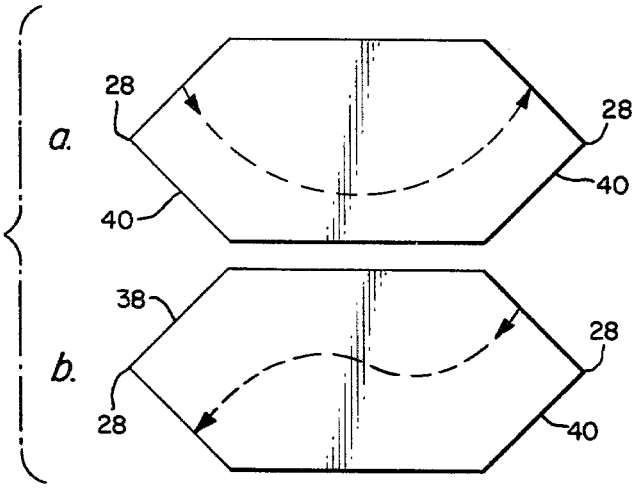
FIGS. 6*a* and 6*b* are diagrammatic illustrations of side views of the heat exchanger core of FIG. 5.

The sheet 10 is pleated to bring the surfaces of adjacent sections 18 and 20 together to form the walls of fluid passages 36 extending therebetween. Alternating crests formed along the lines 34 close the top of one passage and the bottom of the two next adjacent passages. Also, as illustrated in FIG. 5, one half section at either end of each of the fluid passages 36 is closed and the remaining half section is open. The apex 28 at the ends of each section 18 and 20 forms the dividing point between the closed and open sections at the ends of each fluid passage. These closed end sections alternate with adjacent fluid passages, and therefore, when the upper half end section of alternate passages 36 is closed, as illustrate at 38 in FIG. 5, the lower half end section of the intervening passages is closed as illustrated at 40.

The design of the heat exchanger core which is formed from the sheet 10 determines whether or not the same half section at either end of a passage 36 will be closed. For example, with reference to FIG. *6a*, when the core is designed to permit fluid to flow along a "U" shaped path through the passages 36, the same half sections at both ends of a passage will be closed. Conversely, as illustrated in FIG. *6b*, when the fluid flows an "S" or "Z" shaped path, the top half section at one end of the passage is closed and the bottom half section at the opposite end of the passage is closed. In both instances, the alternating end configuration of FIG. 5 is maintained at both ends of the core.

The desired half sections at either end of a passage 36 are closed by means of the tabs 14 and 16. These tabs are either curled up (FIGS. *3a* and *4a*) or down (FIGS. *3b* and *4b*) to achieve the desired closure of an end half section. Referring for example to FIG. 1, the wide tab 16 at the right end of the top section 18 might be curled upwardly (FIG. *4a*), and then the adjacent narrow tab 14 on the middle section 20 would be curled upwardly (FIG. *3a*). The wide tab 16 at the right end of the middle section 20 would be curled downwardly (FIG. *4b*), and the narrow tab 14 on the right end of the bottom section 18 would be curled downwardly (FIG. *3b*). The sequence would begin again with the wide tab 16 at the right end of the lower section 18 (curled upwardly) and would continue throughout the length of the strip 10. The tabs on the left side of the strip 10 may be curled to conform with those on the right edge of the strip if the core of FIG. *6a* is to be formed. Conversely, the tabs on the left side of the strip will be curled opposite to the corresponding tabs on the right edge of the strip if the core of FIG. *6b* is to be formed.

Figure 7:
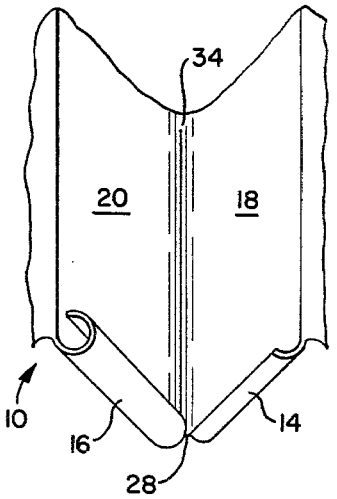
FIG. 7 is a perspective view of a single pleated section of the heat exchanger core of FIG. 5 during the pleating thereof.
Figure 8:
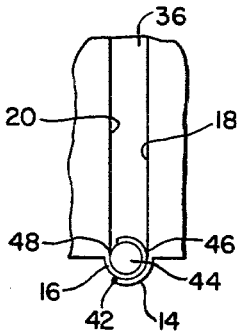
FIG. 8 is a plan view of a single pleated section of FIG. 5 after pleating is completed.

FIGS. 7 and 8 disclose the manner in which the curled tabs on adjacent sections 18 and 20 of the sheet 10 mate when the sheet is pleated. As the sections are brought together, the tab 14 moves into position over the tab 16, and the two tabs may be welded together along the line 42.

Ideally, the wide tab 16 is curled tightly around a wire insert 44 before the tabs are brought together. It will be noted in FIG. 8 that the fluid passage walls formed by the sections 18 and 20 extend tangentially away from points 46 and 48 on the circumference of the wire insert 44. The weld line 42 is located in a low stress area which is removed from the points 46 and 48, and in operation, the thin metal sections 18 and 20 may flex around the wire insert 44 rather than at the welded joint 42.

Figure 9:
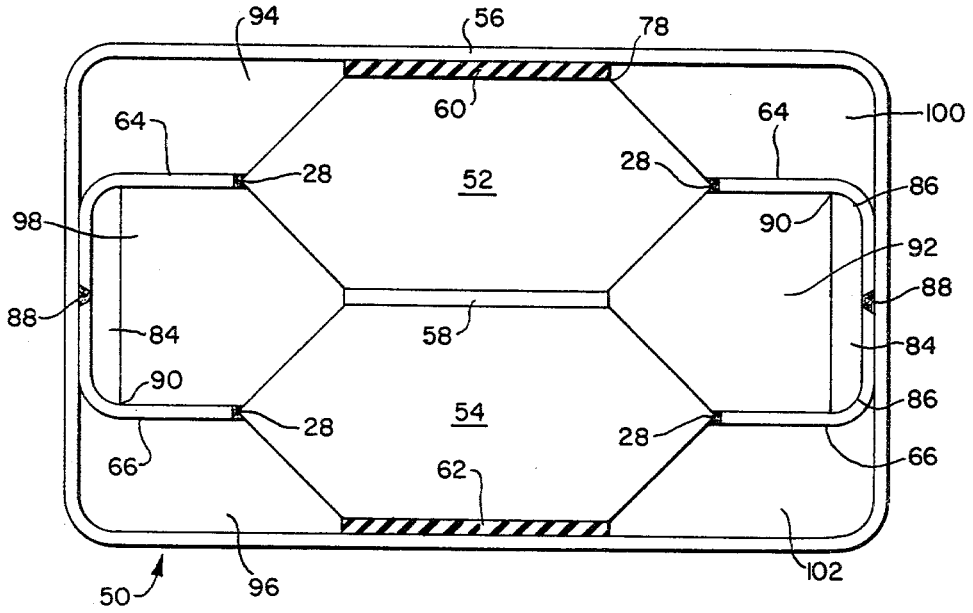
FIG. 9 is a diagrammatic cross sectional view of the low stress heat exchange module of the present invention.

A heat exchanger module 50 constructed in accordance with the present invention may be formed by stacking two or more pleated core assemblies 52 and 54 within a housing 56 as shown in FIG. 9. The upper pleated assembly 52 is placed over the lower pleated assembly 54 with a spacer 58 between them. The spacer may be a mesh or perforated strip or, in some instances, a separator plate or gasket which extends between the pleated assemblies. Similarly, gaskets 60 and 62 seal the open sides of the passages 36 which are not closed by the folds made along lines 34 during pleating.

Figure 10:
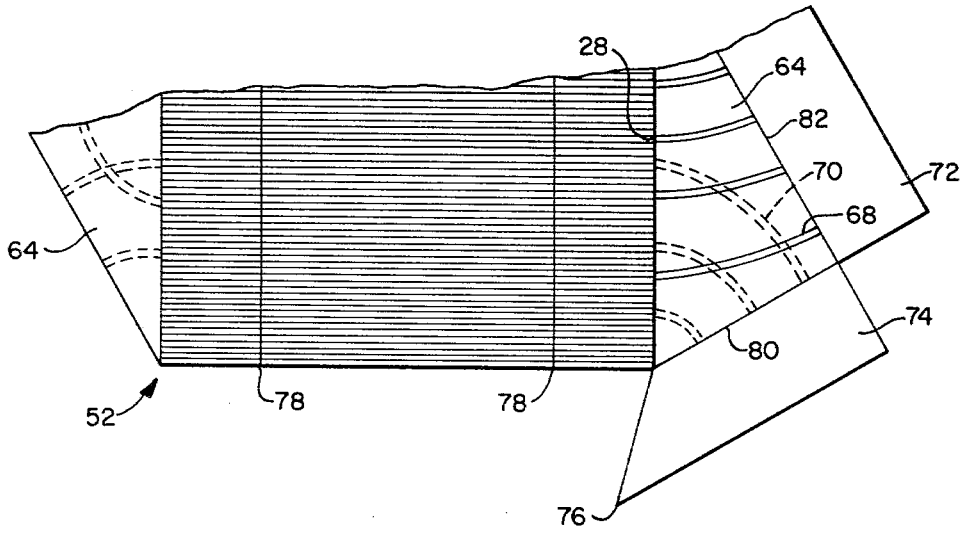
FIG. 10 is a plan view of a section of a heat exchange core for the module of FIG. 9.

Hot and cold fluid manifolds are formed within the module 50 by welding triangular sheets 64 and 66 to the apexes 28 of the core assemblies 52 and 54. These sheets are similar in construction and consequently only one sheet 64 shown in FIG. 10 will be described in detail.

The triangular sheets 64 and 66 are formed from a metallic material which is normally somewhat thicker than the material forming the cores 52 and 54, and since a considerable amount of pressure differential may exist across each sheet, it is desirable to reinforce the sheet with guide vanes 68 and 70 formed on either side thereof. These guide vanes can be spot welded in place onto the triangular sheets and provide the dual function of reinforcement and fluid flow guidance.

Tabs 72 and 74 extend from the outermost edges of each triangular sheet 64 and 66, and the outer corner 76 of each tab should fall even with the line 78 when the tab is folded. The line 78 extends through the points where the angled ends of the cores 52 and 54 meet the fold lines 34.

The tabs 72 and 74 are folded along the lines 80 and 82 and extend over edge bars 84. The edge bars are radiused at 86 in order to reduce the bending stresses in the sheets 64 and 66 as they roll and unroll slightly due to lateral deflections which may be caused by either mechanical or thermal loading. The tabs 72 and 74 are welded to the edge bars 84 along a line 88 which is removed from the points 90 where the sheets 64 and 66 tangentially leave the edge bars. Thus the sheets flex around the edge bars and not the weld.

When the core units 52 and 54 with the triangular sheets 64 and 66 welded thereto and to the edge bars 84 are in place within the housing 56, suitable fluid manifolds for the core units are formed. If the core units are designed for a "Z" flow, air is provided to air inlet manifold 92 and follows a "Z" flow path through the core units 52 and 54 to air outlet manifolds 94 and 96. Simultaneously hot gas is provided to a gas inlet manifold 98 and follows a "Z" flow path to gas exhaust manifolds 100 and 102.

Conversely, if a "U" flow path is to be maintained in the cores 52 and 54, the air inlet manifold 92 would remain the same but manifold 98 would become an air outlet manifold. Manifolds 94 and 96 would be hot gas inlet manifolds while manifolds 100 and 102 would form gas exhaust manifolds.

With reference to FIGS. 5 and 9, it will be noted that the ends of fluid passages 36 above and below the sheets 64 and 66 are alternately open and closed. Since the manifolds are arranged above and below the sheets 64 and 66, hot gasses can be cured to flow in alternating passages while cool air to be heated flows in the intervening passages.

Industrial Applicability

The heat exchanger module 50 may be effectively employed as a recuperator for a gas turbine engine or for other heat exchange applications. The inlet manifold 92 is connected to a source of cool fluid to be heated while the inlet manifold 98 is connected to a source of heated fluid. In a gas turbine engine, the inlet manifold 98 would be connected to receive hot exhaust gases from the engine while the inlet manifold 92 would be connected to receive compressor discharge air from the engine. As the cooler discharge air passes through the pleated core assemblies 52 and 54 with the counter flowing hot exhaust gas, the air is heated by the heat transfer provided by the resultant heat exchange. Junctions within the heat exchange module are formed in accordance with the novel method of this invention wherein thin metal members are wrapped around wires or radiused spacer bars so that the metal members come off tangentially. The welds are placed in areas of low stress so that operational pressure differentials or stresses result in rolling of the metal members relative to the relatively rigid forms about which they are wrapped, and minimum stress occurs at the weld.

Other aspects, objects and advantages of this invention can be obtained from a study of the drawings, the disclosure, and the appended claims.

We claim:

1. A heat exchanger core unit (50) comprising (a) a unitary pleated sheet (10) having a plurality of walls (18, 20) with interconnecting, alternating first and second crest portions (34) extending between adjacent walls (18, 20) on opposite sides thereof, said first crest portions each interconnecting a first (18) and second (20) wall along a first side thereof and said second crest portions each interconnecting said second (20) and the next adjacent first wall (18) along a second side thereof opposite to said first side and (b) closure means (38,40) to define alternating fluid flow passages (36) between said walls (18,20) by closing at least a portion of the space between adjacent walls (18,20) at each end thereof, said closure means (38,40) including (c) tab means (14,16) extending along the ends of each wall (18,20) formed to engage tab means (14,16) on the next adjacent wall (18,20) to bridge a space between the ends of said walls (18,20), said tab means (14,16) being arcuate in cross section and including a first tab (16) extending from a first wall (18) and a second tab (14) extending from a second wall (20) adjacent said first wall (18), said second tab (14) engaging and overlying said first tab (16) when said sheet (10) is pleated, said first (18) and second (20) walls extending tangentially away from spaced points (46,48) on the juncture formed by said first (16) and second (14) tabs, said second tab (14) terminating at a terminal edge which is between and spaced from said spaced points (46,48), the second tab (14) being secured to the first tab (16) at said terminal edge (42).

2. The heat exchanger core unit (50) of claim 1 wherein said first tab (16) is curled much more in degrees than the said second tab (14).

3. The heat exchanger core unit (50) of claim 1 wherein said first tab (16) is wrapped around an elongate, internal support member (44).

4. The heat exchanger core unit (50) of claim 1 wherein said walls (18, 20) are formed with an outwardly extending apex (28) at each end thereof, said tab means (14, 16) being formed to bridge the space between said walls (18, 20) from each of said crest portions (34) to said apexes (28) in a repetitively alternating opposite manner at each end of said core unit (50) to define alternating fluid flow passages (36) between said walls (18, 20).

5. The heat exchanger core unit (50) of claim 4 which includes separator sheet means (64, 66) secured to said apexes (28) at either end of said core unit (50) and operative to separate fluid flow to and from said alternating fluid flow passages (36).

6. The heat exchanger core unit (50) of claim 5 wherein at least one outer edge section (72, 74) of said separator sheet means (64, 66) is secured to an edge support means (84), said edge support means having a radiused surface (86) which contacts said outer edge section (72, 74), said separator sheet means (64, 66) extending tangentially from the radiused surface (86) and said outer edge section (72, 74) being secured to said edge support means (84) at a point (88) spaced from the point where said separator sheet means (64, 66) extends from said radiused surface (86).

7. The heat exchanger core unit of claim 6 wherein the tab means (14,16) on adjacent walls (18,20) are wrapped around an internal, radiused support member (44).

8. The heat exchanger core unit (50) of claim 7 wherein said first tab (16) extends from said first wall (18) for an arcuate distance which is greater than the arcuate distance that said second tab (14) extends from said second wall (20).

9. The heat exchanger core unit (50) of claim 4 wherein each said wall (18,20) includes a first and second tab (16,14) extending from each end thereof, said first tab (16) extending along an end of said wall (18,20) from a first crest (34) to said apex (28) and extending outwardly for a first distance, and said second tab (14) extending along the end of said wall from the apex (28) to a second crest (34) opposite said first crest, and extending outwardly for a second distance which is less than said first distance.

* * * * *